United States Patent [19]

Hutchins

[11] 4,077,165

[45] Mar. 7, 1978

[54] ABRADING TOOL CLIP WITH AUTOMATIC TAKE-UP

[76] Inventor: Alma A. Hutchins, 49 N. Lotus Ave., Pasadena, Calif. 91107

[21] Appl. No.: 745,295

[22] Filed: Nov. 26, 1976

[51] Int. Cl.[2] ..... B24D 15/00

[52] U.S. Cl. ..... 51/386

[58] Field of Search ..... 51/382, 383, 385, 386, 51/387, 170 R, 170 TL, 170 MT, 358

[56] References Cited

U.S. PATENT DOCUMENTS

| | | | |
|---|---|---|---|
| 1,183,444 | 5/1916 | Fisk | 51/387 X |
| 2,635,396 | 4/1953 | Johnson | 51/386 X |
| 2,848,850 | 8/1958 | Metoff | 51/387 X |
| 3,555,743 | 1/1971 | Geiger | 51/382 X |

*Primary Examiner*—Al Lawrence Smith
*Assistant Examiner*—Nicholas P. Godici
*Attorney, Agent, or Firm*—William P. Green

[57] ABSTRACT

A clip for holding an abrading sheet on an abrading tool, and including a clamping element of sheet form spring material which is received opposite and clamps an end of the sheet against a backing surface of a coacting structure, with the clamping element being mounted to that structure by a connecting link which swings to an overcenter position in the clamping condition of the device, and with the backing surface being disposed at a camming angle producing an automatic take-up action for tightening the sheet on the tool as necessary to maintain it in a properly taut condition.

10 Claims, 6 Drawing Figures

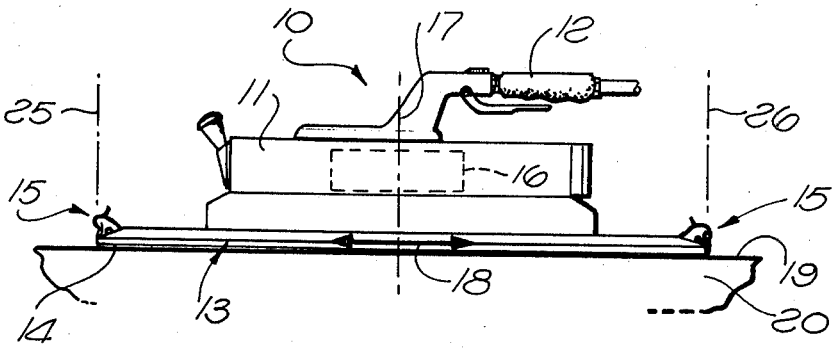
FIG. 1
FIG. 2
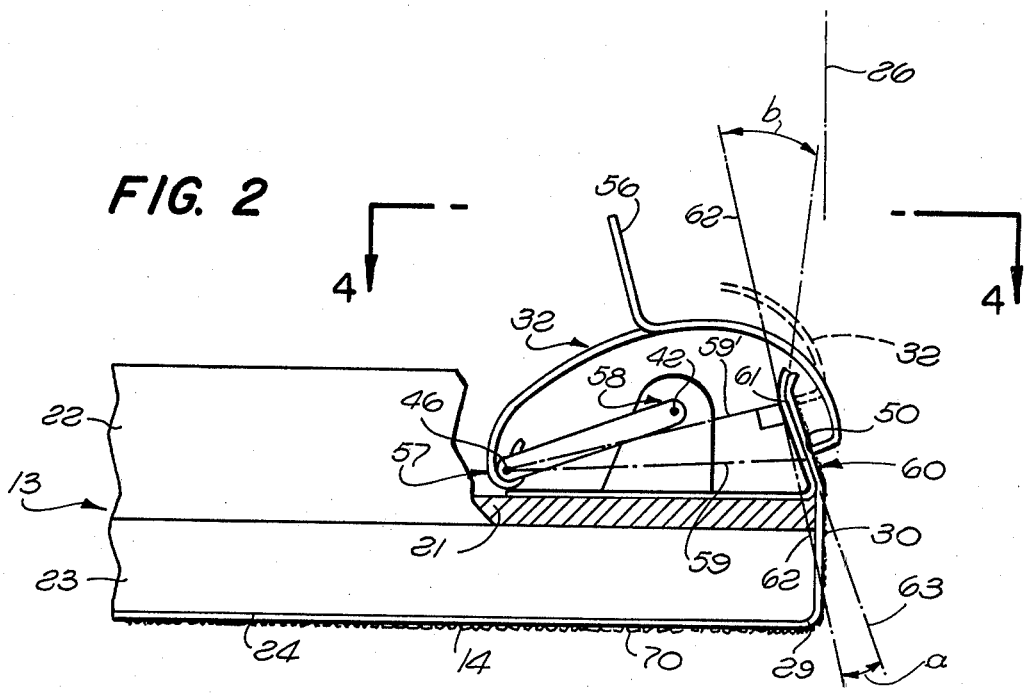
FIG. 3
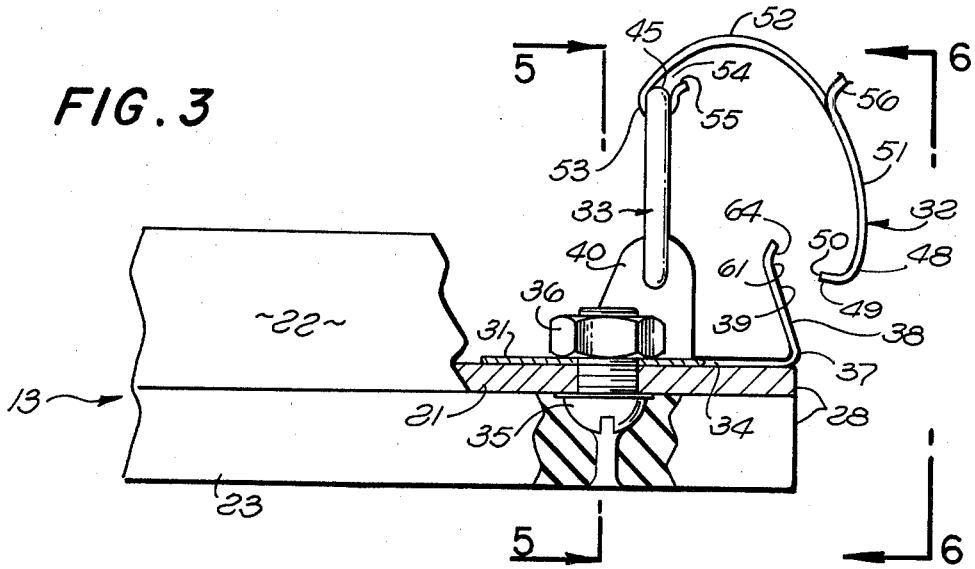

ABRADING TOOL CLIP WITH AUTOMATIC TAKE-UP

BACKGROUND OF THE INVENTION

This invention relates to improved clips for releasably retaining a sheet of abrading material, such as sandpaper, on an abrading tool.

One structurally very simple type of clip which is currently in use for releasably retaining a sheet of sandpaper or the like on an abrading tool includes a clamping element made of sheet form spring material which is bent to have an edge which engages an end of the sandpaper sheet and clamps it against a backing surface. The clamping element is movably mounted by a link member which is pivoted to a support structure for swinging movement about an axis located behind the backing surface, and which is connected to the clamping element for relative pivotal movement about a second axis. In actuating the clamping element to a sandpaper retaining condition, the link swings about the first axis in a relation moving the second mentioned axis to an overcenter position in which the discussed edge of the clamping element is urged tightly against the sandpaper sheet. The retention of the sandpaper by this type of device is in some respects very effective, but is of a nature requiring the exercise of considerable care in pulling the sandpaper tight on the tool during actuation of the clip to clamping condition.

SUMMARY OF THE INVENTION

A major purpose of the present invention is to provide a clip which is of the above discussed general type, but which is specially constructed to have an automatic take-up action, functioning to inherently exert a pulling force on the ends of the abrasive sheet, in a manner effectively maintaining the sheet in taut condition on the shoe of a sander or the like, and continually taking up any looseness in the sandpaper sheet which may initially be present or develop in use of the tool. This take-up action is achieved with no increase in complexity of the clip structure, and is attained without adverse effect on the positive clamping action of the device.

To provide for the take-up action, the backing surface against which the sandpaper sheet is clamped by the spring clamping element is in the present device disposed at a slight camming angle with respect to the remainder of the mechanism, so that the yielding force exerted by the spring element has a tendency to cam or urge the clamping element and engaged abrading sheet in a takeup direction. More particularly, a camming portion of this backing surface is disposed at an angle such that, as that surface advances in the direction in which the abrading sheet must be pulled to take up looseness therein, the surface simultaneously also advances slightly closer to the position which the pivotal axis between the mounting link and clamping element assumes when the device is in its locking condition. When the clamping element is initially actuated to its active clamping condition, it is positioned to contact the abrading sheet material at a location opposite a portion of the angular backing surface which is farther from the mentioned pivotal connection than are other portions of the camming surface which are offset in the take-up direction. The yielding force exerted by the clamping element then tends to force the engaged portion of the abrading sheet toward that axis, and in doing so cams the sheet in take-up direction.

BRIEF DESCRIPTION OF THE DRAWING

The above and other features and objects of the invention will be better understood from the following detailed description of the typical embodiment illustrated in the accompanying drawing in which:

FIG. 1 is a side view of a portable power driven sander tool having sandpaper retaining clips constructed in accordance with the invention;

FIG. 2 is an enlarged fragmentary side view showing one of the clips of the FIG. 1 tool, with the clip illustrated in its active clamping condition;

FIG. 3 is a view similar to FIG. 2, but showing the clip in released condition;

DESCRIPTION OF THE PREFERRED EMBODIMENT

Figure 4:
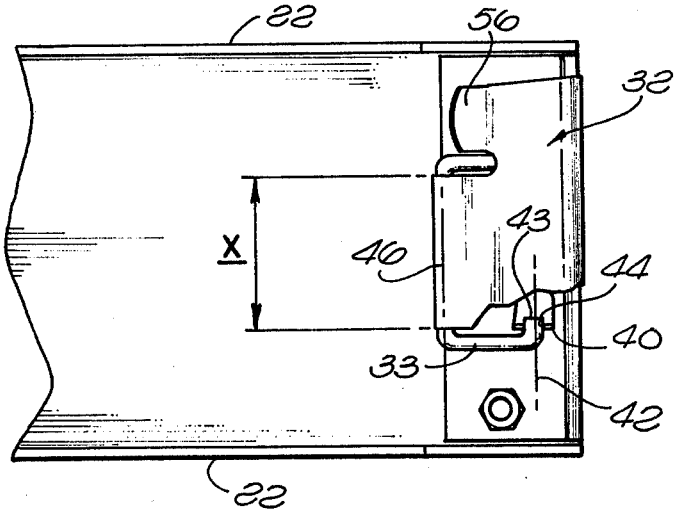
FIG. 4 is a fragmentary plan view taken on line 4—4 of FIG. 2.

The powered sander 10 of FIG. 1 includes a portable body 11 having a handle portion 12 and which movably carries at its underside an abrading unit 13 to which a sheet of sandpaper or other abrading material 14 is connected by a pair of spring clips 15. The shoe 13 and carried sandpaper are driven relative to body 11 by a motor 16 carried by the body, in any desired type of sanding movement, such as orbitally about a vertical axis 17, or in a straight line reciprocating motion along a front to rear axis 18 of the tool.

The shoe 13 extends essentially horizontally in the FIG. 1 position of the tool, and is illustrated as positioned for sanding the upper horizontal surface 19 of the workpiece 20. As seen best in FIGS. 2 and 3, the shoe 13 may include an upper rigid horizontal plate 21, which is preferably formed of sheet aluminum and is driven by motor 16, and which may have parallel upwardly turned vertical flanges 22 extending along its opposite side edges. At the underside of plate 21, the shoe includes a layer of cushioning material 23, which may be formed of rubber whose upper surface is bonded continuously to plate 21 and whose undersurface 24 extends horizontally in the illustrated position of the tool and may be irregularized. At their opposite ends, the parts 21 and 23 of shoe 13 are cut off in vertical parallel planes 25 and 26 disposed transversely of the front to rear axis 18 of the tool to provide end edges 28 of parts 21 and 23 lying in those planes.

The sandpaper sheet 14 extends horizontally along the undersurface 24 of shoe 13, and at its opposite ends is turned upwardly at 29 to have an essentially vertical portion 30 at each end retained by the corresponding clip 15 to hold the sandpaper on the shoe.

The two clip assemblies 15 may be identical, and consequently only one of these assemblies has been illustrated in detail in FIGS. 2 to 6. With reference to those figures, each of these clips may include a base or mounting part 31, a clamping element 32, and a connecting link 33. The part 31 may be stamped from sheet metal, preferably steel, of a composition and thickness sufficient to render the part 34 essentially rigid, though it is contemplated that if desired the part may have some very slight resilient deformability under the forces exerted by clamping element 32 in use. Part 31 may be shaped to have a main horizontal mounting portion 34 secured to the upper surface of part 21 by screws 35 extending through registering apertures in parts 21 and 34 and carrying nuts 36 at their upper ends. At the locations of the end edges 28 of parts 21 and 23 of the shoe, base element 31 is bent upwardly at 37 to form an upwardly extending flange 38 having a backing surface 39 against which the back side of sander sheet 14 is engageable. At a location behind flange 38 (leftwardly in FIGS. 2 and 3), there are stamped out of portion 34 of part 31 a pair of upstanding parallel mounting lugs 40, lying in a pair of vertical planes 41 which are parallel to and symmetrical with respect to the front to rear axis 18 of the tool. These lugs 40 mount link 33 for pivotal movement relative to part 31 about a horizontal axis 42 which extends transversely of the tool (i.e. parallel to the end planes 25 and 26 of the shoe). For this purpose, link 33 may have end portions 43 which are turned inwardly toward one another along axis 42 and through aligned apertures 44 in parts 40 to mount the link for the desired pivotal swinging movement between the active clamping position of FIG. 2 and the retracted or open position of FIG. 3.

Figure 5:
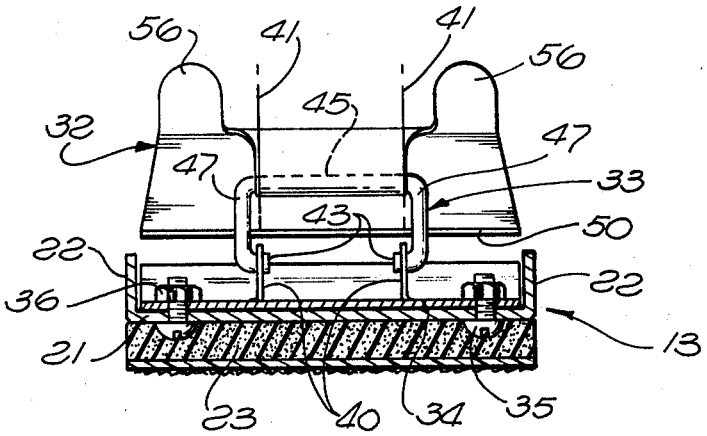
FIG. 5 is a vertical section taken on line 5—5 of FIG. 3.

Link 33 may be formed of a single length of rigid externally cylindrical wire or rod material, bent to have the generally U-shaped configuration illustrated in FIG. 5. More particularly, the link may have a main cross piece portion 45 extending along an axis 46 which is parallel to axis 42, with a pair of parallel arms 47 of the link projecting from portion 45 and carrying at their extremities the previously mentioned inwardly turned terminal portions 43 of the link.

Figure 6:
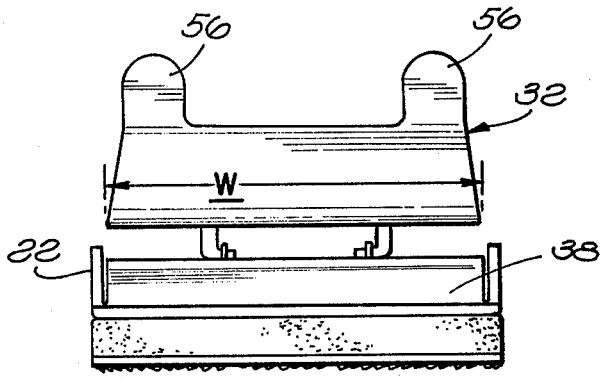
FIG. 6 is an end view taken on line 6—6 of FIG. 3.

Clamping part 32 is stamped from sheet form spring material, desirably spring steel, which normally returns by its resilience to the condition or shape illustrated in FIGS. 3, 5 and 6, but which is slightly deformed in the FIG. 2 condition to exert a strong yielding spring force against the sandpaper for tightly clamping it against flange 38. At its right end as viewed in FIGS. 2 and 3, the clamping spring 32 has a portion 48 which can extend downwardly in front of or opposite flange 38, and which has a portion 49 turned inwardly toward the flange to present an edge 50 adapted to engage the abrasive side of sandpaper sheet 14 and press it against the flange. Edge 50 is narrow vertically to engage the sandpaper opposite only a localized portion of the backing surface 39 of flange 38, and may follow essentially a straight line extending transversely of the shoe and parallel to surface 39. Portions 48 and 49 and edge 50 of the clamping spring are desirably of a width *w* transversely of the shoe corresponding essentially to the width of the shoe itself and part 31 and its flange 38.

In extending upwardly from its portions 48 and 49, the clamping spring 32 curves gradually rearwardly at 51, and then has a portion 52 of a reduced width *x* (FIG. 4) which curves downwardly and rearwardly to a location at which return bend portion 53 is looped essentially circularly about portion 45 of link 33 to form a pivotal connection therewith, connecting the clamping spring 32 to the link for relative pivotal movement about the previously mentioned axis 46. After being doubled back about portion 45 of the link, the material of clamping spring 51 is shaped to form a resricted gap 54 of a width less than the diameter of portion 45 of the link to effectively lock the link in its pivotally connected position with respect to the spring, while at the same time allowing initial connection of the parts by forcing portion 45 of the link past a camming surface 55 of the spring to temporarily spread the spring to increase the width of gap 54 as the parts are moved together. After such connection, the strength of the material of clamping spring 32 is sufficient to prevent detachment of parts 32 and 33 from their pivotally interconnected condition under the influence of forces encountered in use. At the upper side of part 32, the material of this part is cut and shaped to form a pair of upwardly turned handle or actuating tabs 56, located at opposite sides of the portion 52 of part 32, and adapted to be utilized for manually actuating the clamping part between its FIG. 2 and FIG. 3 positions.

In the FIG. 2 active clamping condition of the device, the counterclockwise swinging movement of the pivotal connection 57 between parts 32 and 33 is limited by engagement of the return bend hinge portion 53 of part 32 with the upper surface of horizontal portion 34 of the base part 31 of the clip assembly. In that clamping condition of FIG. 2, the axis 46 of pivotal connection 57 is slightly overcenter with respect to axis 42 of the other pivotal connection 58 and clamping edge 50 of part 32. That is, in this clamping condition of FIG. 2 a line or plane 59 extending between axis 46 and edge 50 is located downwardly beyond or overcenter with respect to axis 42, to thereby positively retain the clip in this FIG. 2 condition. Under the automatic take-up action which will be discussed in greater detail hereinbelow, edge 50 may move upwardly relative to flange 38 from a location such as that shown in full lines in FIG. 2 to a predetermined uppermost clamping position represented in broken lines at 32' in FIG 2. In that uppermost position, the line or plane extending between axis 46 and edge 50 is positioned as illustrated at 59'. It is noted particularly that the discussed overcenter relationship between the parts remains even in this uppermost position 59' of the clamping element, and of course in all intermediate positions between those represented at 59 and 59', and any settings to which the clamping part may be moved lower than the one represented in full lines in FIG. 2.

To attain the automatic take-up action, flange 38 is so shaped that its backing or clamping surface 39 has a main camming portion 60, extending upwardly from the location 37 to a location 61. At each point along the entire vertical extent of this camming portion 60, surface 39 is disposed at a camming non-perpendicular angle with respect to a line (such as 59 or 59') extending from the FIG. 2 active position of axis 46 to that particular portion of the camming surface. This camming angularity is represented in FIG. 2 by illustration at 62 of a plane disposed perpendicular to the line 59' which extends from axis 46 to the uppermost portion 61 of the camming surface, and by representation at 63 of the plane of the camming portion 60 of surface 39, with the angle *a* between these planes representing the deviation of the camming surface from a precisely perpendicular condition with respct to line 59'. At the location of the line 59 of FIG. 2, this deviation from perpendicularity is slightly greater than the illustrated angle *a*. However, at all locations along the vertical extent of camming portion 60 of backing surface 39, the angle of deviation from perpendicularity is rather small, and is preferably not greater than about 20° (optimally between about 5° and 15°). It is noted that this angularity is in a direction such that, as the camming portion 60 of surface 39 advances upwardly from its lowermost portion 37, that camming surface gradually advances closer to the axis 46, so that a yielded force exerted leftwardly by the resilience of spring 32 against the sandpaper at the location of edge 50 will, by tending to urge the sandpaper toward axis 46, exert an upward camming force against the sandpaper causing it to be automatically tightened on the shoe, and will do so at all positions of the clamping edge 50 between a lowermost position opposite the bottom portion of flange 38 and the uppermost position represented in broken lines at 32' in FIG. 2.

Upwardly beyond the upper edge 61 of camming portion 60 of surface 39, the surface 39 has a portion 64 which reverses its direction of advancement, in that as portion 64 continues upwardly it commences to advance farther away from rather than closer to axis 46, so that the discussed camming action must terminate at the broken line position 32' of FIG. 2, and the discussed portion 64 of surface 39 acts as a stop limiting upward movement of edge 50 relative to the flange. This reverse angularity of portion 64 with respect to the perpendicular plane 62 is represented by the angle *b* of FIG. 2. At the juncture of the portions 60 and 64 of surface 39, there is then formed a horizontal valley at the previously mentioned location 61, toward which valley the camming action urges edge 50.

In attaching the sandpaper sheet 14 to shoe 13, the sandpaper is first positioned adjacent the undersurface of the shoe with the abrasive particles of sheet 14 facing downwardly, following which the opposite ends of the sheet are turned upwardly for reception between the two clamping springs 32 and their corresponding flanges 38. During initial insertion of the ends of the sandpaper sheet between these parts, clamping spring 32 is of course in a released position similar to that shown in FIG. 3. After an end of the sandpaper sheet has been positioned between the corresponding flange 38 and element 32, a user exerts force against the handle lugs 56 (leftwardly in FIG. 3), to swing link 33 and the carried part 32 to the FIG. 2 active positions. During such swinging movement, the user exerts downward force on part 32 to cause its edge 50 to be received opposite a lower portion of flange 38, as far beneath the location 61 as possible. The final swinging movement of parts 32 and 33 to the overcenter position of FIG. 2 causes edge 50 to be pulled tightly against the sandpaper sheet, at a location opposite a lower portion of flange 38 as illustrated in FIG. 2. Engagement of edge 50 with the irregularities formed by the sanding particles 70 on the surface of sandpaper sheet 14 prevents movement of edge 50 upwardly relative to the sandpaper sheet, so that any upward movement of edge 50 will cause corresponding upward movement of the engaged portion of the sheet by virtue of this interfitting relation between edge 50 and the projections on the sandpaper. Spring 32 is in the FIG. 2 condition distorted slightly so that its resilience tends to urge edge 50 leftwardly toward axis 46, to attain the previously described automatic take-up action causing edge 50 and the engaged portion of the sandpaper sheet to shift upwardly as close to the broken line position 32' of FIG. 2 as is possible. This camming movement is halted when the sandpaper sheet reaches a very taut condition on shoe 13, and the continuing tendency for further camming action acts at all times to maintain that taut condition and take up any slack which may develop in the sandpaper sheet. Preferably, the clip is applied in a manner such that edge 50 never actually reaches the extreme position represented at 32' in FIG. 2, but always has a capability for further take-up action. By virtue of the very small camming angularity *a* of camming surface 60, the take-up action may not occur until the sander is actually placed in operation, at which time the vibrational movements of the sanding shoe under the influence of motor 16 will immediately cause the take-up action even at that slight camming angle and produce the desired taut effect of the sandpaper on the shoe.

While a certain specific embodiment of the present invention has been disclosed as typical, the invention is of course not limited to this particular form, but rather is applicable broadly to all such variations as fall within the scope of the appended claims.

I claim:

1. An automatic take-up clip for holding a sheet of abrading material on an abrading tool, comprising:

a first structure having a backing surface adjacent which an end portion of said abrading sheet is to be received;

a clamping element made of sheet form spring material and having a clamping portion adapted to be received opposite said backing surface and to clamp the abrading sheet thereagainst;

a link structure for movably mounting said clamping element;

first pivotal connection means attaching said link structure to said first structure for swinging movement relative thereto about a first axis located behind said backing surface;

second pivotal connection means attaching said clamping element to said link structure for relative pivotal movement about a second axis which upon pivotal movement of said link structure about said first axis swings between a released position freeing said abrading sheet from clamped retention by said element and an active clamping position in which said second axis is behind said first axis and slightly overcenter with respect to said first axis and said clamping portion of said element, and in which active position said clamping portion is yieldingly urged tightly against said abrading sheet by the reslience of the clamping element;

said backing surface having a camming portion which, at each of a series of different locations along a predetermined path of take-up movement, is disposed at a slight camming angle of not more than about 20° with respect to a plane perpendicular to a straight line extending between said active position of said second axis and the part of said camming portion of the backing surface which is nearest to said active position of the second axis, so that as said camming portion advances in a predetermined abrading sheet take-up direction it also advances slightly closer to said active position of the second axis;

said clamping portion of said clamping element being adapted, upon initial actuation of the clamping element to active position, to be received opposite, and clamp said sheet against, a part of said camming portion of the backing surface which is relatively far from said second axis, and to then be cammed with the sheet, by the yielding force of said clamping element, along said camming portion of the surface in said take-up direction and to positions opposite regions of said camming portion which are progressively closer to the second axis, to thereby automatically take up slack in the sheet;

said clamping portion being constructed to grip the sheet in a manner tending to cause the sheet by such gripped engagement to hold said clamping portion of the clamping element against movement in take-up direction except in conjunction with corresponding movement of the sheet to thereby attain said automatic take-up action.

2. A clip as recited in claim 1, including means limiting the cammed displacement of said clamping portion of said element in said take-up direction relative to said backing surface.

3. A clip as recited in claim 1, in which said backing surface has a portion located beyond said camming portion thereof in said take-up direction and which advances farther from said active position of said second axis and thereby limits cammed displacement of said clamping portion of said element in the take-up direction.

4. A clip as recited in claim 1, in which said clamping portion of said clamping element is formed as an edge portion of said sheet form spring material turned inwardly toward said backing surface and contacting the abrading sheet.

5. A clip as recited in claim 1, in which said sheet form clamping element of spring material has at least one turned portion forming a handle tab for manually actuating the clamping element between its different positions.

6. A clip as recited in claim 1, in which said second pivotal connection means include an elongated rod like hinge portion of said link structure, and a portion of said sheet form spring material of the clamping element curved about said elongated portion of the link structure and closely embracing it to interconnect the link structure and clamping element for relative pivotal movement about said second axis.

7. A clip as recited in claim 1, in which said first structure includes a sheet metal plate having a mounting portion attachable to an upper surface of said abrading tool in generally horizontal condition and having an inclined flange projecting upwardly at an oblique angularity with respect to said mounting portion and shaped to form said backing surface.

8. A clip as recited in claim 1, in which said backing surface has a portion which is located beyond said camming portion thereof in said take-up direction and which progressively advances farther from said active position of said second axis to limit movement of said clamping portion of the clamping element in take-up direction, said sheet form spring material of the clamping element being turned inwardly toward said backing surface to form said clamping portion and having a narrow edge facing the backing surface for engagement with said sheet, said link structure including an elongated element having aligned turned ends coacting with hinge bearings on said first structure to constitute said first pivotal connection means, said second pivotal connection means including a portion of said elongated element enclosed within a curved doubled back portion of said clamping element in pivoting relation, said clamping element having turned portions forming handle tabs for manually actuating the clamping element between different positions thereof.

9. An automatic take-up clip for holding a sheet of abrading material on an abrading tool, comprising:

a first structure having a backing surface adjacent which an end portion of said abrading sheet is to be received;

a clamping element made of sheet form spring material and having a clamping portion adapted to be received opposite said backing surface and to clamp the abrading sheet thereagainst;

a link structure for movably mounting said clamping element;

first pivotal connection means attaching said link structure to said first structure for swinging movement relative thereto about a first axis located behind said backing surface;

second pivotal connection means attaching said clamping element to said link structure for relative pivotal movement about a second axis which upon pivotal movement of said link structure about said first axis swings between a released position freeing said abrading sheet from clamped retention by said element and an active clamping position in which said second axis is behind said first axis and slightly overcenter with respect to said first axis and said clamping portion of said element, and in which active position said clamping portion is yieldingly urged tightly against said abrading sheet by the resilience of the clamping element;

said backing surface having a camming portion which, at each of a series of different locations along a predetermined path of take-up movement, is disposed at a slight camming angle of not more than about 20° with respect to a plane perpendicular to a straight line extending between said active position of said second axis and that particular location, so that as said camming portion advances in a predetermined abrading sheet take-up direction it also advances slightly closer to said active position of the second axis;

said clamping portion of said clamping element being adapted, upon initial actuation of the clamping element to active position, to be received opposite, and clamp said sheet against, a part of said camming portion of the backing surface which is relatively far from said second axis, and to then be cammed with the sheet, by the yielding force of said clamping element, along said camming portion of the surface in said take-up direction and to positions opposite regions of said camming portion which are progressively closer to the second axis, to thereby automatically take up slack in the sheet;

said clamping portion being constructed to grip the sheet in a manner tending to cause the sheet by such gripped engagement to hold said clamping portion of the clamping element against movement in take-up direction except in conjunction with corresponding movement of the sheet to thereby attain said automatic take-up action.

10. A clip as recited in claim 9, in which said backing surface has a portion which is located beyond said camming portion thereof in said take-up direction and which progressively advances farther from said active position of said second axis to limit movement of said clamping portion of the clamping element in take-up direction, said sheet form spring material of said clamping portion of the clamping element being turned inwardly toward said backing surface and having a narrow edge facing the backing surface for engagement with said sheet, said link structure including an elongated element having aligned turned ends coacting with hinge bearings on said first structure to constitute said first pivotal connection means, said second pivotal connection means including a portion of said elongated element enclosed within a curved doubled back portion of said clamping element in pivoting relation, said clamping element having turned portions forming handle tabs for manually actuating the clamping element between different positions thereof, said first structure including a sheet metal plate having a mounting portion attachable to an upper surface of said abrading tool in generally horizontal condition and having an inclined flange projecting upwardly at an oblique angularity with respect to said mounting portion and shaped to form said backing surface.

* * * * *